US005630322A

United States Patent [19]

Heilmann et al.

[11] Patent Number: 5,630,322

[45] Date of Patent: May 20, 1997

[54] PROCESS AND APPARATUS FOR HEAT TREATMENT OF WORKPIECES BY QUENCHING WITH GASES

[75] Inventors: Paul Heilmann, Maintal; Klaus Löser, Mainhausen; Friedrich Preisser, Büdingen, all of Germany

[73] Assignee: Ald Vacuum Technologies GmbH, Erlensee, Germany

[21] Appl. No.: 471,996

[22] Filed: Jun. 6, 1995

[30] Foreign Application Priority Data

Jun. 28, 1994 [DE] Germany ..... 44 22 588.1

[51] Int. Cl.[6] ..... F25D 13/06

[52] U.S. Cl. ..... 62/63; 62/95; 62/434

[58] Field of Search ..... 62/95, 434, 375, 62/63

[56] References Cited

U.S. PATENT DOCUMENTS

| | | | |
|---|---|---|---|
| 3,184,349 | 5/1965 | Burwen | 148/125 |
| 4,078,392 | 3/1978 | Kestner | 62/434 |
| 4,643,401 | 2/1987 | Obman et al. | 266/80 |
| 5,105,633 | 4/1992 | Briggs | 62/434 |
| 5,121,903 | 6/1992 | Ripley | 266/250 |
| 5,152,605 | 10/1992 | Yamada et al. | 62/375 |

FOREIGN PATENT DOCUMENTS

| | | |
|---|---|---|
| 0189759 | 8/1986 | European Pat. Off. . |
| 0562250 | 2/1993 | European Pat. Off. . |
| 1452062 | 10/1976 | United Kingdom . |

OTHER PUBLICATIONS

Listemann, "Gestuftes Abkuhlen Zum Härten und Isothermes Umwandeln" HTM 41(1986) 1, pp. 28–32.

Conybear, "High Pressure Gas Quenching", Advanced Materials & Processes Jul. 1993, pp. 20–21.

Heilmann et al, "Gas Quenching Tool Steels", Advanced Materials & Processes Feb. 1993, pp. 29–31.

*Primary Examiner*—Ronald C. Capossela
*Attorney, Agent, or Firm*—Felfe & Lynch

[57] ABSTRACT

Workpieces are quenched by gases in a heat-treatment system (1) and the circulated gases are recooled on cooling surfaces (12, 15) in at least one heat exchanger (11, 14), the cooling surfaces (15) of the heat exchanger (14) are cooled by a primary refrigeration unit (20) and a refrigerant to temperatures below 0° C., preferably to temperatures below –20° C. or even below –40° C., to increase the intensity of the quenching. To reduce the size and power of the refrigeration unit (20), the quenching gas is sent in succession through at least one heat exchanger (11) cooled with water and at least one heat exchanger (14) cooled by a refrigerant. To reduce the size and power of the refrigeration unit (20) even further, this unit and a secondary refrigerant are used initially to cool down a storage volume of the primary refrigerant, such as a cooling brine, being stored under little or no pressure, to a temperature below 0° C., whereupon this primary refrigerant is sent through the heat exchanger (14), at least one of which is present.

14 Claims, 4 Drawing Sheets

PROCESS AND APPARATUS FOR HEAT TREATMENT OF WORKPIECES BY QUENCHING WITH GASES

BACKGROUND OF THE INVENTION

The invention pertains to a process for the quenching of workpieces with gases in a heat-treatment system and for recooling the circulated gases on cooling surfaces in at least one heat exchanger.

High-quality tools of hot-forming and cold-forming tool steels and of high-performance high-speed steels are usually heat-treated today in vacuum heat-treatment systems by high-pressure gas quenching.

As a result of the further development of high-pressure gas quenching in the direction of higher gas pressures and gas velocities, and also because of the choice of suitable quenching gases, it is possible to expand the use of this technology to the area of low-alloy steels and case-hardening steels. In these cases, work is carried out at gas pressures of up to 20 bars. The current system technology, however, makes it possible only to treat workpieces with relatively thin walls or cross sections and small batch sizes.

This technology leads necessarily to the use of high-pressure tanks for the heat treatment and gas quenching and of heat-treatment systems with thick walls. The construction and sealing of the flange joints as well as of the doors or covers of the heat-treatment systems are especially challenging.

The level of the quenching intensity which can be achieved is largely determined by the choice of gas, the gas pressure, the gas velocity, and the gas temperature. The level of the gas temperature influences the amount of heat which can be carried away from the batch and thus affects the quenching intensity by way of the thermal conductivity coefficient $\alpha$ and the driving temperature difference between the batch and the quenching gas.

The level of the gas temperature is influenced by, among other things, the heat exchanger used to recool the quenching gas. Through the use of cooling water as coolant on the secondary side of the heat exchanger, the level of the gas outlet temperature behind the heat exchanger remains limited even at optimum efficiency to values on the order of about 30°–50° C.

SUMMARY OF THE INVENTION

According to the invention at least one heat exchanger is provided and the cooling surfaces of this heat exchanger are cooled by a refrigeration unit and a refrigerant to temperatures below 0° C.

It is especially advantageous in this case for the cooling surfaces of the heat exchanger to be cooled to temperatures below −1° C., and preferably even to temperatures below −40° C.

Operating by way of the material parameters density, thermal conductivity, dynamic viscosity, and specific heat capacity, the lowering of the gas temperature brings about a significant increase in the coefficient of thermal conductivity at the same pressure. In particular, it is possible to achieve a significant reduction in the cooling time.

The process according to the invention also makes it possible to achieve a high quenching intensity for large workpieces and/or large batches. By taking advantage of the option to increase the quenching intensity, it then becomes possible to operate at lower pressures, as a result of which the investment costs for a system of this type can be significantly reduced. Conversely, if it is desired to use high pressures, it is possible to increase the quenching intensity significantly.

To keep the size or power of the refrigeration unit within bounds, it is especially advantageous to conduct the quenching gas successively through at least one heat exchanger cooled in the conventional manner with water and then through at least one additional heat exchanger cooled with a refrigerant.

As a result of these design provisions, it is possible to cool the quenching gas emerging from the batch, this gas being temporarily at a temperature of more than 400° C., in a first heat exchanger cooled with water to a temperature of 50° C. and then to send the gas at this temperature to the second heat exchanger, which is cooled by a refrigerant, as a result of which the temperature can be lowered to, for example, −50° C. This very highly cooled gas is now sent by way of a blower in a circuit back to the batch to be quenched, as a result of which the cycle repeats. The batch temperature can therefore be lowered very quickly. In this manner, it is possible to cool a batch of several 100 kg, for example, from a starting temperature of 1,000° C. to a temperature of 200° C. within a period of only 3 minutes.

Normally, a refrigeration unit must be designed with respect to its size and power in such a way that the quantity of heat which accumulates can also be dissipated within the time allowed.

To achieve a further reduction in the size and power of the refrigeration unit, it is advantageous to use the refrigeration unit and a first refrigerant initially to cool a storage volume of a second refrigerant, which is being stored under little or no pressure, to a temperature below 0° C. and then to conduct this second refrigerant through the heat exchanger, at least one of which is provided.

In the case of a heat-treatment system which is divided into a heat treatment furnace and a quenching chamber, it is again advantageous to transfer the batch from the heat-treatment furnace to the quenching chamber and to subject it there to the action of the quenching gases.

As a result of this measure, it is no longer necessary to carry away the heat still present in the heat-treatment furnace, especially the heat present in its internal fittings, by means of the one or more heat exchangers. The heat-treatment furnace can therefore be kept at its operating temperature. As a result, the load on the refrigeration unit is much lighter.

It is advantageous to use a cooling brine as the second refrigerant, that is, a salt solution with a salt concentration sufficient to prevent freezing in a reliable manner. Alternatively, some other antifreeze agent such as monohydric and/or polyhydric alcohols can be added to the water.

It is advantageous for the storage volume of the second refrigerant to be as large as possible, since the power required of the refrigeration unit decreases as the size of the storage volume increases. The refrigerant in question can therefore absorb very large amounts of the heat carried away during quenching. The time interval between the heat treatment and the quenching of successive batches is sufficient to allow the refrigeration unit to cool the second refrigerant back down to the required low temperature of, for example, −50° C. to −60° C. before it is needed again.

By means of the invention, it is possible even in the simplest case to use the quenching technique to harden materials which have heretofore been impossible to harden, i.e., so-called cooling-critical materials, and to shorten the duration of the process.

The invention also pertains to a heat-treatment apparatus for the quenching of workpieces, with at least one heat exchanger for recooling the circulated quenching gases on cooling surfaces.

According to the invention the heat exchanger, at least one of which is provided, is connected to a refrigeration unit.

Preferably, at least one heat exchanger connected to a water circuit and at least one heat exchanger connected to a refrigerant circuit are connected in series in the flow direction of the quenching gas.

The refrigeration unit preferably includes an evaporator, which is submerged in a storage tank for the primary refrigerant, which can be stored under little or no pressure. This storage tank is connected by way of a circuit line to at least one of the heat exchangers.

An especially compact system is obtained by dividing the internal space of the heat treatment furnace into a batch area and a cooling area, through which the quenching gas can flow in succession, and by installing in succession in the cooling area at least one heat exchanger for operation with cooling water and at least one heat exchanger for operation with a refrigerant.

For the reasons given above, it is especially advantageous in this case for the heat-treatment system to be divided into a heat-treatment furnace and a quenching chamber; for at least one heat exchanger to be provided, which is connected directly or indirectly to the refrigeration unit; and for this heat exchanger to be assigned exclusively to the quenching chamber.

DETAILED DESCRIPTION OF THE PREFERRED EMBODIMENTS

Figure 1:
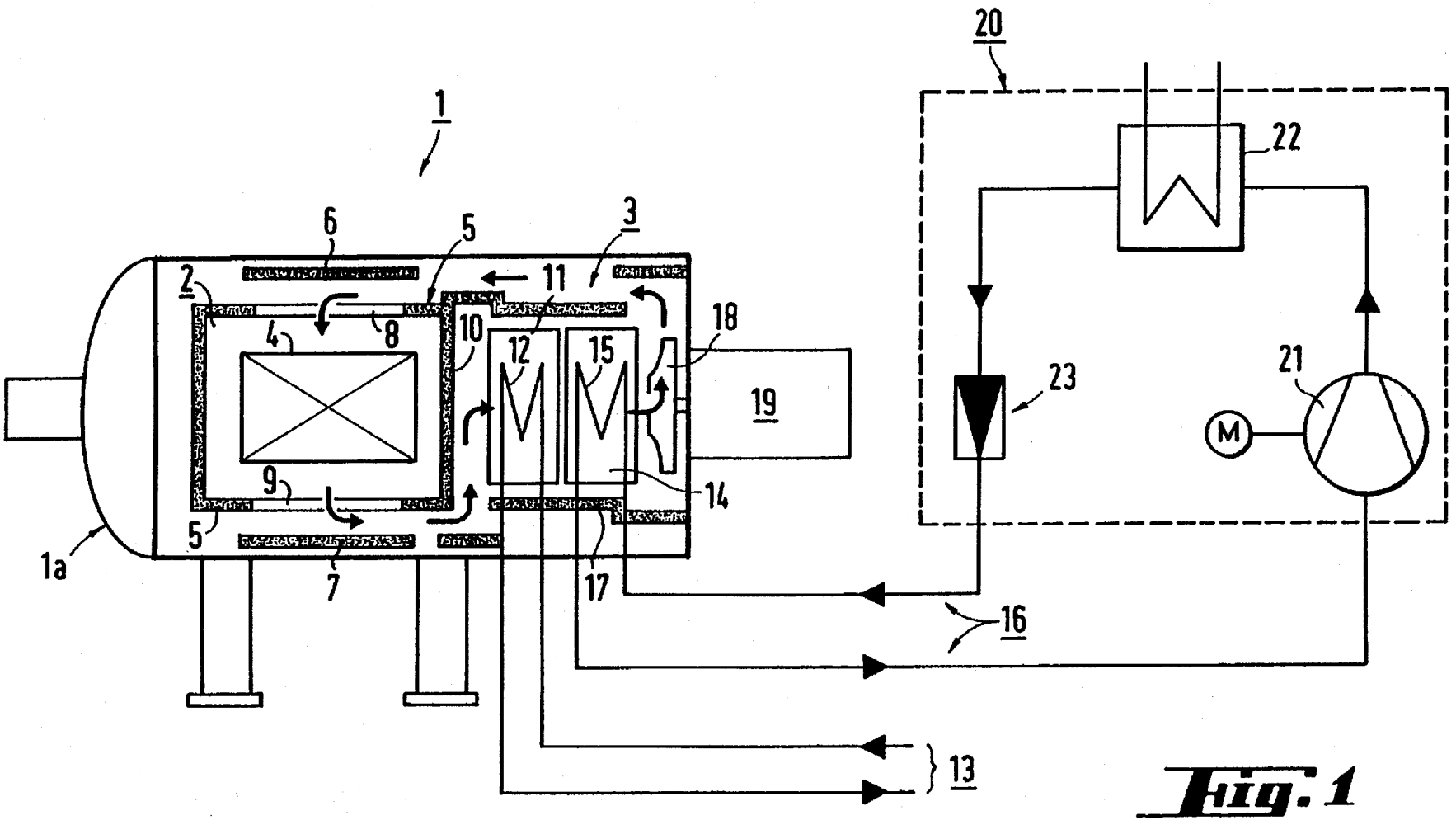
FIG. 1 shows a diagram of a first embodiment of apparatus and a process with two heat exchangers, one of which is connected directly to a refrigeration unit.

FIG. 1 shows a heat-treatment system 1 with a heat-treatment furnace 1*a*, which is designed as a vacuum furnace. Its interior space is divided into a batch area 2 and a cooling area 3. In batch area 2, there is a batch 4, consisting of numerous workpieces; this area is surrounded by thermal insulation 5. The thermal insulation includes two movable gates 6, 7, which serve to control a stream of cooling gas through openings 8, 9 in the direction of the flow arrows. The heating equipment required to heat batch 4 has been omitted for the sake of simplicity. Batch area 2 is separated from cooling area 3 by a wall 10, which belongs to thermal insulation 5.

In cooling area 3 there is a first heat exchanger 11 with first cooling surfaces 12, on the secondary side of which cooling water is conducted in a water circuit, of which only circuit line 13 is indicated.

Behind first heat exchanger 11 in the flow direction of the quenching gases, there is a second heat exchanger 14 with cooling surfaces 15, the secondary side of which is connected to a refrigerant circuit by means of circuit lines 16.

The two heat exchangers 11, 14 are surrounded by additional thermal insulation 17. By means of a blower 18 with a drive motor 19, it is possible to guide the quenching gas, after gates 6, 7 have been opened, around in a circuit in the direction shown by the flow arrows.

The refrigerant circuit with circuit line 16 includes a refrigeration unit 20, which is designed in the conventional manner, and which comprises a compressor 21, a condenser 22, and a throttle device 23. A conventional refrigerant is conducted through circuit line 16 through second heat exchanger 14, cooling surfaces 15 of which thus form the walls of an evaporator, so that a powerful heat-removing effect is exerted on the quenching gas.

The way in which the device according to FIG. 1 operates is as follows: Batch 4 is heated to a temperature of, for example, 1,000° C. During quenching, blower 18 conveys cold quenching gas through opened upper gate 6 into batch area 2, which is designed as a heating chamber. As the quenching gas passes through hot batch 4, it warms up as it simultaneously cools the batch. The quenching gas, which is now hot, leaves the heating chamber through the opened lower gate 7 and flows through water-cooled first heat exchanger 11. The quenching gas is thus cooled to a temperature of about 50° C. For further cooling, the gas now flows through second heat exchanger 14, which is operated on the secondary side with the previously described refrigerant as cooling medium. As a result, the quenching gas is cooled inside second heat exchanger 14 to about −50° C., and this cooled gas stream is sent back again by blower 18 to batch area 2 and conducted over the batch. As already stated, cooling surfaces 15 of second heat exchanger 14 form the evaporator of refrigeration unit 20. In second heat exchanger 14, the refrigerant enters at a temperature of, for example, −60° C. The refrigerant evaporates as a result of the uptake of heat from the quenching gas flowing along the primary side. After it emerges from heat exchanger 14, i.e., from its evaporator, the refrigerant vapor is compressed by compressor 21 and condensed in condenser 22 installed further down the line. After the refrigerant has been throttled in throttling device 23, the refrigerant again enters second heat exchanger 14. In this way, it is possible to lower the batch temperature from 1,000° C. to 200° C. within a period of 3 minutes and thus to quench the batch. The pressure of the refrigerant in second heat exchanger 14 in this case is about 30 bars.

Figure 2:
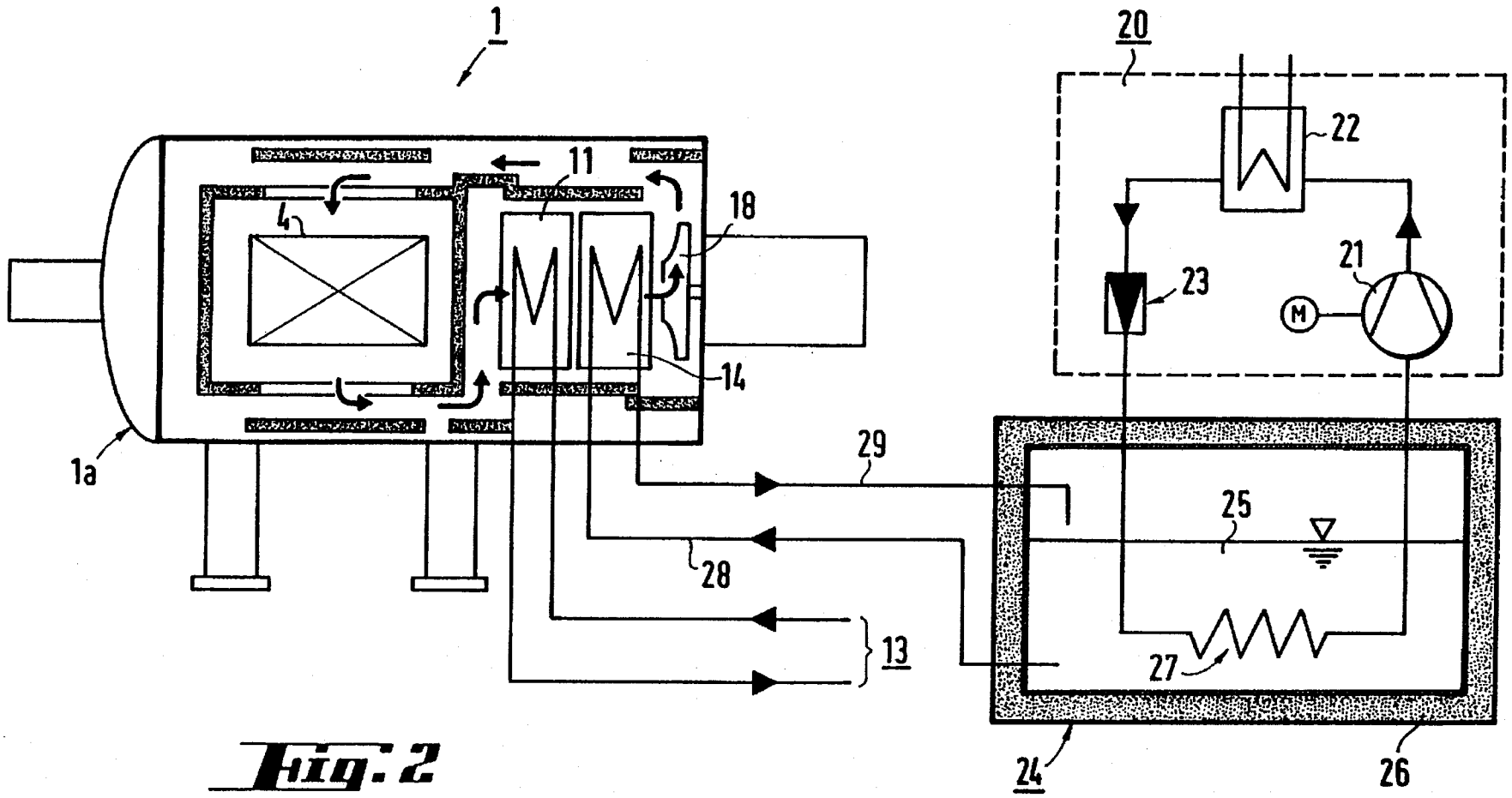
FIG. 2 shows a diagram of a second embodiment of apparatus and a process with two heat exchangers, one of which is connected indirectly, by way of a storage tank, to a refrigeration unit.
Figure 3:
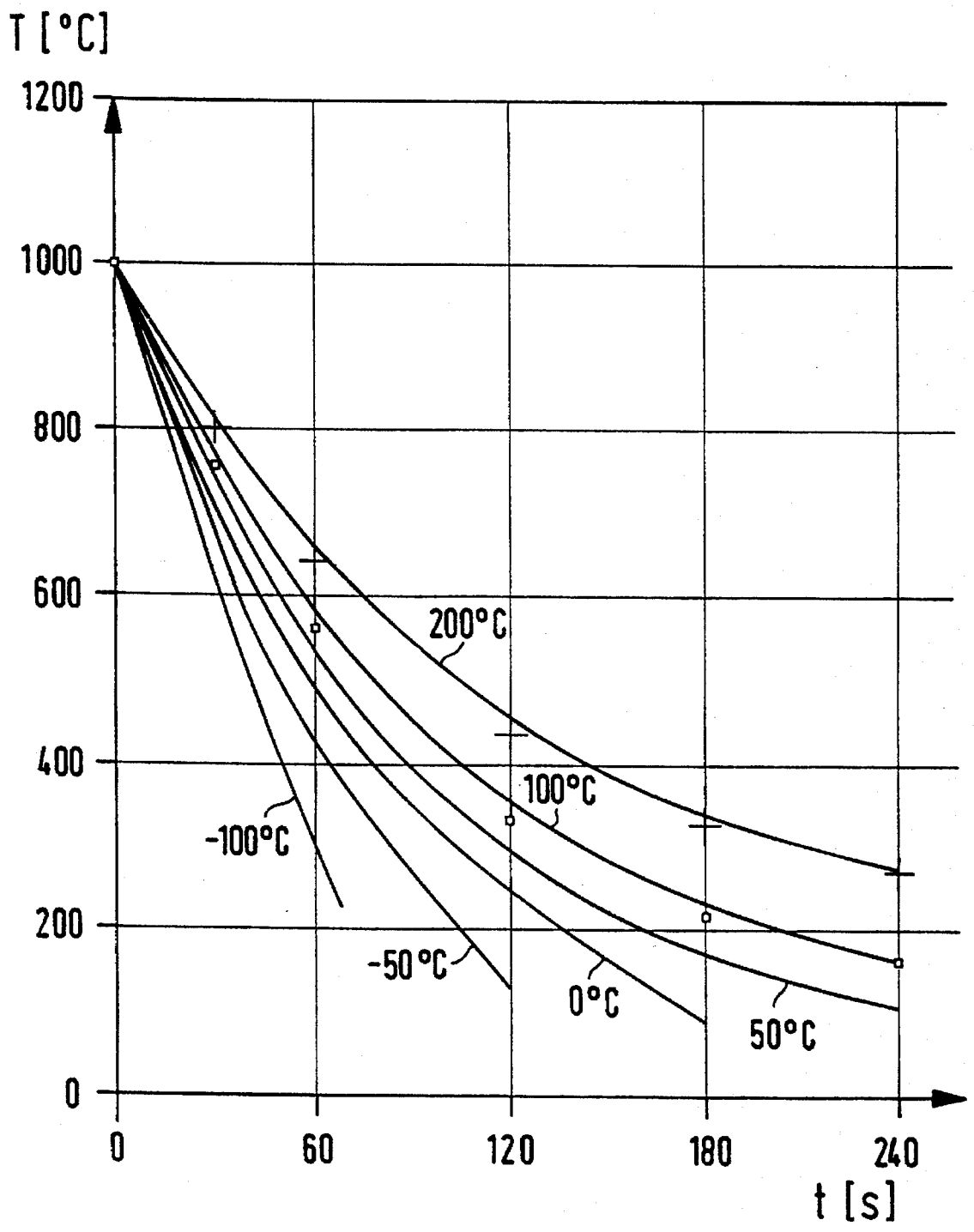
FIG. 3 shows a parameter graph, which explains how the quenching intensity depends on the temperature of the quenching gas.

Heat-treatment furnace 1*a* according to FIG. 2 is identical to that of FIG. 1, so that there is no need to repeat the description. In this exemplary embodiment, however, a storage tank 24 is also provided, in which a primary refrigerant 25, which can be stored without pressure is held. This consists, for example, of a salt solution or cooling brine, so that it is impossible for it to freeze within the temperature ranges in question here. Storage tank 24 is therefore an unpressurized container, although it is surrounded by thick thermal insulation 26 and has a relatively large volume, capable of holding, for example, several thousand liters of refrigerant 25. In this case, refrigeration unit 20 has an evaporator 27, through which a secondary refrigerant is conducted. The evaporator is submerged in previously described primary refrigerant 25, so that it is cooled to the required operating temperature of −50° to −60° C. Storage tank 24 is connected to second heat exchanger 14 by a circuit line, which consists of feed line 28 and return line 29. As a result, the same intense cooling action is achieved in second heat exchanger 14, although primary refrigerant 25 forms a kind of buffer, which, depending on the amount of refrigerant being stored, heats up slightly during the quenching process of batch 4, but which, in the intervals between the individual quenching processes, is cooled back down again by refrigeration unit 20. FIG. 3 shows the cooling time t in seconds on the abscissa, whereas the workpiece temperatures T are plotted in °C. on the ordinate. These curves were determined for steel bolts with a diameter of 25 mm in a helium atmosphere with a pressure of 20 bars.

The numerical value given on each curve represents the average gas temperature in batch area 2 of the heat-treatment furnace. It is easy to see that the quenching rate or quenching intensity increases quickly with decreasing temperature of the quenching gas. Conversely, the cooling time t decreases proportionately. It is now possible, because of the increase in the quenching rate achievable by the use of highly cooled gases, to quench alloys which could not previously be quenched quickly enough by a process of pure high-pressure gas quenching.

When a storage volume with a refrigerant is used, it is preferable to provide only a single heat exchanger.

Figure 4:
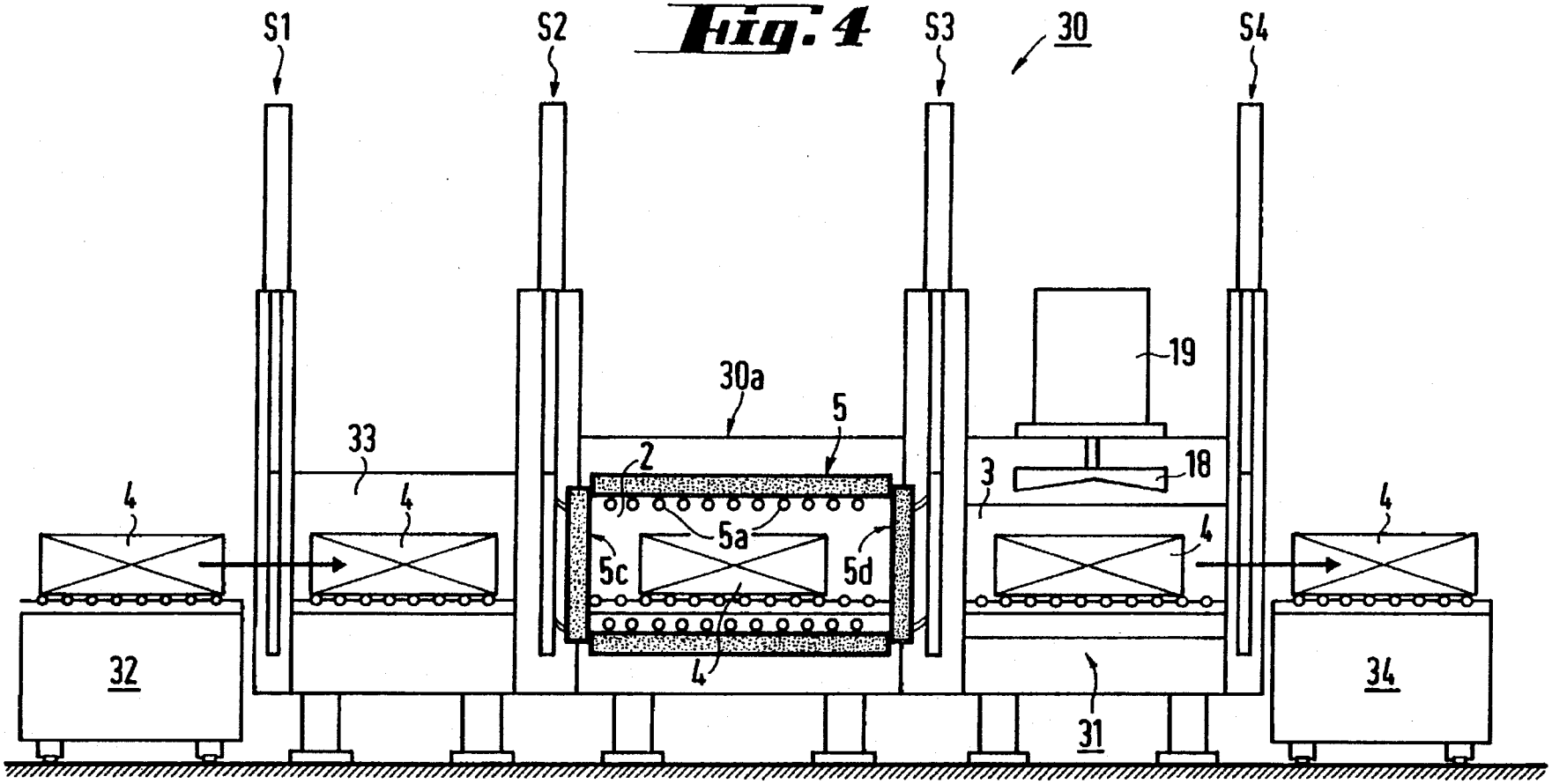
FIG. 4 is the diagram of a third embodiment of apparatus in which the heat-treatment system is divided into a heat-treatment furnace and a quenching chamber.

FIG. 4 shows a heat-treatment system 30, which is designed as a cycling, multi-chamber system, equipped with four gas-tight lock valves S1, S2, S3, S4. Batch 4 is introduced from a loading cart 32 and pushed into a receiving chamber 33 after lock valve S1 has been opened. After lock valve S1 has been closed, the atmosphere and the pressure in receiving chamber 33 are adjusted to match the values in heat treatment furnace 30*a*. In the furnace, batch 4, which has been introduced through lock valve S2, is again surrounded by thermal insulation 5 and a heating device 5*a*. Components 5*c*, 5*d* of thermal insulation 5 following each other in the transport direction are connected movably to lock valves S2, S3, respectively.

After the furnace has been heated up and possibly after a gas treatment, lock valve S3 is opened, and batch 4 is transported into a quenching chamber 31. Then lock valve S3 is closed. In a manner similar to that shown in FIGS. 1 and 2, quenching chamber 31 has assigned to it at least one heat exchanger (not shown), through which the quenching gas is circulated by a blower 18 and thus cooled to temperatures significantly below 0° C. After quenching, quenching chamber 31 is brought to atmospheric pressure; lock valve S4 is opened; and batch 4 is transported to the outside and onto another loading cart 34.

In this case, the additional advantage is obtained that the temperature of the components in heat treatment furnace 30*a* remains almost completely unchanged. In the same way, the temperature in quenching chamber 31 at the time when a new batch is introduced is on at least nearly the same low temperature level as that which prevailed at the end of the quenching process of the preceding batch in the quenching chamber. As a result, very abrupt temperature changes and unnecessary energy losses are largely prevented, and again the load on the refrigeration unit is lightened.

We claim:

1. Process for quenching workpieces with a quenching gas comprising quenching said workpieces by passing said quenching gas over said workpieces, thereby heating said quenching gas, passing said quenching gas through a heat exchanger having cooling surfaces which are cooled with a primary refrigerant, and cooling said primary refrigerant to a temperature below 0° C. by circulating said primary refrigerant in a closed circuit through refrigeration apparatus comprising a refrigeration unit.

2. Process as in claim 1 wherein said refrigerant is cooled to a temperature below −40° C. in said refrigeration unit.

3. Process as in claim 1 further comprising passing said quenching gas through a heat exchanger having cooling surfaces which are cooled with water, prior to passing said quenching gas through said heat exchanger having cooling surfaces cooled by a primary refrigerant.

4. Process as in claim 1 wherein said primary refrigerant is circulated through a tank containing a volume of said primary refrigerant, said volume being cooled by a secondary refrigerant which is cooled in said refrigeration unit.

5. Process as in claim 4 wherein said primary refrigerant is a cooling brine.

6. Process as in claim 4 wherein said primary refrigerant is a mixture of water and an organic antifreeze agent.

7. Process as in claim 1 wherein, prior to quenching, said process comprises heating said parts in a heat treatment chamber, and transferring said parts from said heat treatment chamber to a quenching chamber.

8. Process as in claim 1 wherein said quenching gas is recirculated by passing by passing over said workpieces again after passing through said heat exchanger.

9. Process as in claim 8 wherein said workpieces and said heat exchanger are located in a heat treatment furnace, said furnace having a batch area where said workpieces are quenched and a cooling area where said heat exchanger is located.

10. Apparatus for heat treatment of workpieces, comprising a heat treatment furnace for heating said workpieces, means for passing a quenching gas over said workpieces subsequent to heating, a heat exchanger having cooling surfaces cooled by a primary refrigerant, said gas being passed over said cooling surfaces, and refrigeration apparatus for cooling said primary refrigerant, said refrigeration apparatus comprising a refrigeration unit.

11. Apparatus as in claim 10 further comprising a heat exchanger having cooling surfaces cooled by water, which heat exchanger is located in series between said means for passing a quenching gas over said workpieces and said heat exchanger having cooling surfaces cooled by a primary refrigerant.

12. Apparatus as in claim 10 wherein said refrigeration apparatus comprises a storage tank containing a volume of said primary refrigerant, an evaporator containing a secondary refrigerant submerged in said volume, said evaporator being connected to said refrigeration unit, and circuit means connecting said tank to said heat exchanger.

13. Apparatus as in claim 10 wherein said means for passing a quenching gas over said workpieces comprises a quenching chamber which is separate from said heat treatment chamber, said cooling surfaces of said heat exchanger being located in said quenching chamber.

14. Apparatus as in claim 10 wherein said heat treatment furnace comprises a batch area, where said quenching gas is passed over said workpieces subsequent to heating, and a cooling area, where said heat exchanger is located, whereby said quenching gas may be recirculated from said cooling area to said batch area without passing outside the furnace.

* * * * *